United States Patent [19]

Ward et al.

[11] Patent Number: 4,631,536

[45] **Date of Patent: * Dec. 23, 1986**

[54] MULTIPLEX SUBMERSIBLE PUMP TELEMETRY SYSTEM

[75] Inventors: Donald H. Ward, Glen Ellyn; James R. Tomashek, Wood Dale, both of Ill.

[73] Assignee: Hughes Tool Company, Houston, Tex.

[ * ] Notice: The portion of the term of this patent subsequent to Apr. 8, 2003 has been disclaimed.

[21] Appl. No.: 541,939

[22] Filed: Oct. 14, 1983

Related U.S. Application Data

[63] Continuation-in-part of Ser. No. 376,792, May 10, 1982, Pat. No. 4,581,613.

[51] Int. Cl.[4] ..... G01V 1/40

[52] U.S. Cl. ..... 340/857; 340/858; 367/81; 367/78

[58] Field of Search ..... 340/857, 858, 859, 853; 367/78, 79, 80, 81

[56] References Cited

U.S. PATENT DOCUMENTS

| | | | |
|---|---|---|---|
| 3,284,669 | 11/1966 | Boyd | 317/13 |
| 3,340,500 | 9/1967 | Boyd et al. | 340/18 |
| 3,518,623 | 6/1970 | Langford | 340/870.17 |
| 3,587,076 | 6/1971 | Grover | 340/182 |
| 3,727,179 | 4/1973 | Bennett | 340/859 |
| 3,810,387 | 5/1974 | Stancliff | 73/151 |
| 4,157,535 | 6/1979 | Balkanli | 340/18 CM |
| 4,178,579 | 12/1979 | McGibbeny et al. | 340/856 |
| 4,302,835 | 11/1981 | McMahon | 367/79 |

*Primary Examiner*—Salvatore Cangialosi
*Assistant Examiner*—Ian J. Lobo
*Attorney, Agent, or Firm*—James E. Bradley

[57] ABSTRACT

A submersible well pump has a system for monitoring parameters such as pressure and temperature in the vicinity of the motor. The system includes a downhole assembly in the well that has a transmitter for generating a carrier signal and superimposing that signal onto the power cable. Transducers in the downhole assembly sense physical parameters and provide a change in resistance corresponding to the physical parameters. These transducers are connected to a modulator which modulates the carrier signal according to the resistance. A shift register in the downhole assembly sequentially shifts a reference resistor and two or more transducers into the modulating circuit to provide envelopes on the carrier signal corresponding to a synchronizing signal and to data being sensed. The modulated carrier signal is demodulated at the surface into separate channels, where each can provide a readout proportional to the physical parameter sensed.

4 Claims, 6 Drawing Figures

CARRIER OSCILLATOR
SWITCH
LINE DRIVER
FILTERS
POWER SUPPLY
POINT "A"
BILATERAL SWITCH
BILATERAL SWITCH
BILATERAL SWITCH
BILATERAL SWITCH
TRANSDUCER #1
TRANSDUCER #2
TRANSDUCER #3
POINT "Q2"
POINT "Q1"
CL
Q
Q̄
R
D
CL
Q
Q̄
R
D
3
2
1
0

NOR GATE TRUTH TABLE

| A | B | C |
|---|---|---|
| 0 | 0 | 1 |
| 1 | 0 | 0 |
| 0 | 1 | 0 |
| 1 | 1 | 0 |

MULTIPLEX SUBMERSIBLE PUMP TELEMETRY SYSTEM

CROSS-REFERENCE TO RELATED APPLICATION

This application is a continuation-in-part of Ser. No. 376,792 filed May 10, 1982 U.S. Pat. No. 4,581,613, issued Apr. 8, 1986 and entitled SUBMERSIBLE PUMP TELEMETRY SYSTEM.

BACKGROUND OF THE INVENTION

1. Field of the Invention

This invention relates in general to electrically driven submersible pumps, and in particular to a means for sensing pressure and temperature at the pump and providing a surface readout concurrently.

2. Description of the Prior Art

The submersible pump installations concerned herein include a large electric motor located in the well. the electric motor receives three-phase power over a power cable from the surface. The electric motor drives a centrifugal pump to pump well fluid to the surface.

It is desirable to be continuously aware at the surface of the downhole operating conditions of the pump. This includes knowledge of the pressure of the lubricant in the motor, which is substantially the same as the well fluid pressure, and also the temperature. It would also be useful to have a surface readout of other environmental parameters, such as water content of the motor lubricating oil.

U.S. Pat. No. 3,340,500, Sept. 5, 1967, Boyd, et al, shows a means for measuring the pressure in a submersible pump system. U.S. Pat. No. 4,178,579, Dec. 11, 1979, McGibbeny, et al., shows means for measuring both pressure and temperature by using steering diodes and a relay. Both of these patents show devices that superimpose a DC level on the AC power conductors, with the changes in the DC level being proportional to the physical parameters sensed. There are other patents that show this telemetry means as well. No prior art known to applicants shows means for measuring more than two physical parameters, or means for sensing the parameters other than by superimposing a DC level on the AC power conductors.

SUMMARY OF THE INVENTION

In this invention, a downhole assembly is located in the well in the vicinity of the motor. The downhole assembly includes a transmitter for generating a signal and for superimposing the signal on the power cable. The downhole unit also has sensing means that provides an electrical response proportional to a physical parameter in the vicinity of the well. A modulating portion of the downhole unit modulates the signal being sent uphole in proportion to the sensing means. The sensing means includes a plurality of transducers, each of which provides a variable resistance corresponding to a physical parameter. Sequencing means in the downhole assembly switches each of the transducers separately and sequentially into the modulating means to provide a carrier signal with envelopes of duration corresponding to the resistance of each of the transducers.

Conversion means at the surface detects the length of each envelope and converts the length into readout signals proportional to each of the physical parameters. The conversion means includes decoding means which directs the signals corresponding to the particular envelope to separate readout means which converts the duration of the envelopes into readout signals.

DESCRIPTION OF THE PREFERRED EMBODIMENT

Figure 1:
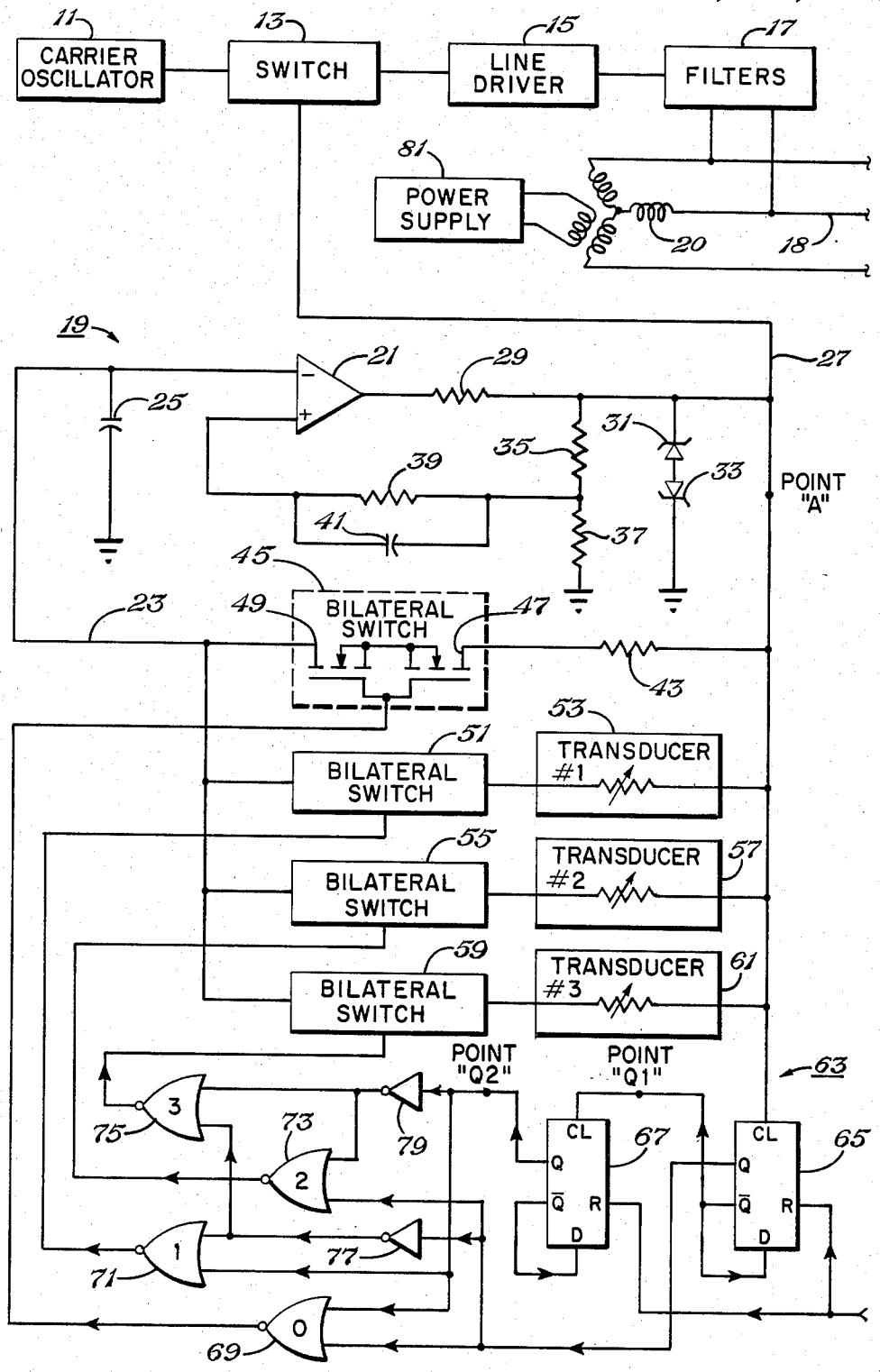
FIG. 1 is a block diagram of the downhole portion of a telemetry system constructed in accordance with this invention.

FIG. 1 discloses the downhole portion of the invention. A carrier oscillator 11 generates a high frequency such as 10 khz. A switch 14 switches on and off the carrier frequency. Switch 13 leads to a line driver 15 for applying the modulated carrier frequency through filter 17 to two of the power cables 18. The power cables 18 supply high voltage, three-phase power to a downhole motor 20. The frequency of the power supplied will be much less than the frequency of the carrier oscillator 11, such as 60 cycles per second. A more detailed description of a suitable carrier oscillator 11, switch 13, line driver 15, and filter 17 is contained in the parent application to this application, all of which material is hereby incorporated by reference.

A modulating means 19 opens and closes switch 13 to provide a modulated carrier signal of high frequency onto the power cables 18. The modulating means 19 is an astable multivibrator that includes a differential amplifier or comparator 21. Comparator 21 has its negative input connected to a line 23. A capacitor 25 is connected to line 23 and to ground. The output of comparator 21 is connected to a line 27 through a resistor 29. Line 27 when positive or high turns on switch 13 to pass the carrier frequency 11. Two Zener diodes 31 and 33 are connected opposite to each other and to ground and to line 27. A voltage dividing circuit comprising resistors 35 and 37 is connected between line 27 and ground. A resistor 39 is connected between the junction of resistors 35 and 37 and to the positive input of comparator 21. A capacitor 41 is connected in parallel across resistor 39.

The timing or operating frequency of the astable multivibrator of modulator 19 is determined by capacitor 25 and a resistance, which in the reference mode is a known reference or synchronizing resistor 43. Resistor 43 is connected to line 27 and to line 23 through a bilateral switch 45. Bilateral swich 45, in the preferred embodiment, comprises two FET transistors 47 and 49.

Figure 2:
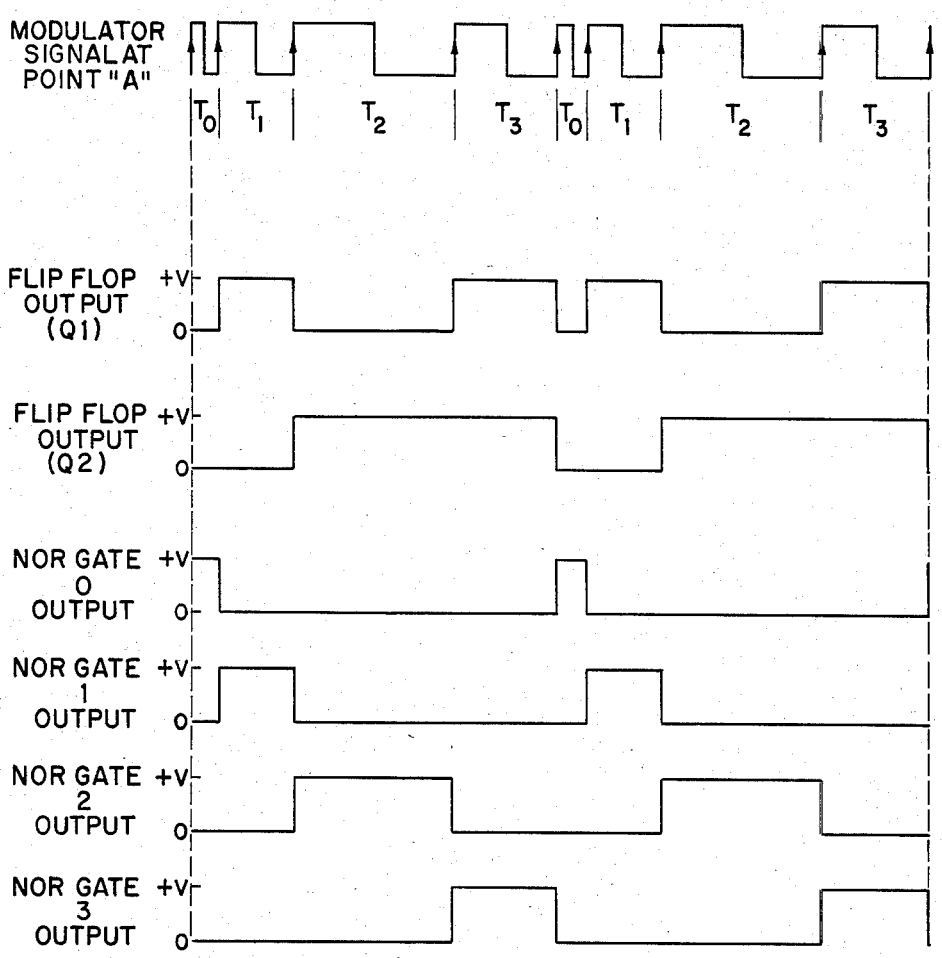
FIG. 2 is a series of waveforms of various points in the block diagram.

When the bilateral switch 45 is closed, voltage will build up at the negative input of comparator 21, as capacitor 25 charges. Once the level of the negative input reaches the level of the positive input, the comparator 21 will go low, causing capacitor 25 to discharge through the resistor 43 until the inputs to comparator 21 again equal each other. FIG. 2 shows that the waveform at point A is an on and off signal $T_0$ of equal duration that opens and closes the switch 13 at an equal duration. The total time $T_0$ of the on and off signal depends upon the values of the capacitor 25 and resistor 43.

In the preferred embodiment, there are three data channels, each containing a bilateral switch and a transducer that are sequentially switched into the modulator 19 to provide signals corresponding to parameters sensed. Bilateral switch 51 and transducer 53 are connected in series and connected in parallel across bilateral switch 45 and reference resistor 43. Transducer 53 is of a conventional type transducer that is mounted below the motor chamber, but in communication with the lubricant oil contained in the motor for sensing a parameter such as pressure of the lubricant. Similarily, a bilateral switch 55 and its transducer 57 are connected in parallel across bilateral switch 51 and transducer 53. Transducer 57 also is mounted in communication with the lubricant oil and will sense temperature. A bilateral switch 59 and a transducer 61 are also connected in parallel across bilateral switch 45 and resistor 43. Transducer 61 also is mounted in communication with the lubricant oil of the motor, and could be used to sense another parameter, such as the water content contained in the lubricant oil.

A sequencing means 63, which may be a shift register, ring counter or other logic type, sequentially shifts the transducers 53, 57 and 61 into the modulator 19. The sequencing means 63 includes two D flip-flops 65 and 67. The clock input to flip-flop 65 is connected to the output of line 27 of the modulator 19. Flip-flops 65 and 67 are connected conventionally so that flip-flop 65 will trigger on receipt of a rising pulse at its clock input. Flip-flop 67 will trigger on receipt of a rising pulse from the $\overline{Q}$ terminal of flip-flop 65. Both flip-flops 65 and 67 have reset lines connected to a power on reset pulse.

Figure 3:
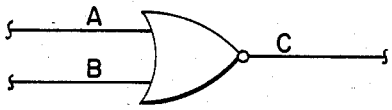
FIG. 3 is a truth table for the NOR gate elements used in the telemetry system of this invention.

The Q outputs of the flip-flops 65 and 67 are connected to a series of NOR gates to provide controlling signals in sequential order to the bilateral switches 45, 51, 55 and 59. The conventional NOR gate truth table, shown in FIG. 3, shows that only when both inputs to a NOR gate are low, will the output be high. The timing diagrams for the NOR gates and the flip-flops at the various points are shown in FIG. 2.

More specifically, the Q output of flip-flop 65 is connected to a NOR gate 69. The other input to NOR gate 69 is connected to a NOR gate 71 and to the Q output of flip-flop 67. A NOR gate 73 is connected to the Q output of flip-flop 65 and to the input of a NOR gate 75. NOR gate 75 has its other input connected to NOR gate 71. An inverter 77 is connected between the Q output of flip-flop 65 and one input of NOR gate 71. An inverter 79 is connected between one input of NOR gate 75 and the Q output of flip-flop 67. Power for the various downhole components is supplied through a power supply 81 which is located downhole and receives power through inductive coupling from the windings in the stator of the motor 20.

In the operation of the downhole portion, referring to FIG. 1 and FIG. 2, a rising pulse at the clock input of flip-flop 65 results in two low inputs being present only at NOR gate 69, which closes bilateral switch 45. Capacitor 25 will charge until it reaches the level at the positive input of comparator 21, then discharge, providing the $T_0$ (FIG. 2) signal or synchronizing envelope, the duration of which depends upon the resistance 43.

Once it discharges to the level at the positive input of comparator 21, comparator 21 will again go high, causing flip-flop 65 to go high on its Q output, while the second flip-flop 67 remains low at its Q output. This results in two zero outputs at NOR gate 71, closing bilateral switch 51. The modulator cycle is repeated, with the time interval $T_1$ (FIG. 2) proportional to the resistance in the first transducer 53.

The rise at the modulator output then causes the flip-flop 65 to provide a low output. This low output applied to the clock input of flip-flop 67, results in a high output on flip-flop 67. This combination turns on the NOR gate 73 and the bilateral switch 55. The time interval $T_2$ is proportional to the resistance of the second transducer 57. Similarily, the next rising signal indicating the conclusion of the time interval $T_2$ causes flip-flop 65 to go high again, while the second flip-flop 67 remains high. This combination turns on the third NOR gate 75, which turns on the bilateral switch 59 and the third transducer 61. At the conclusion of this time interval, $T_3$, the synchronizing signal through resistor 43 will repeat. The resistance of resistor 43 is chosen so that the $T_0$ in the preferred embodiment is less than any of the times $T_1$, $T_2$ and $T_3$ that could occur.

Figures 4, 5:
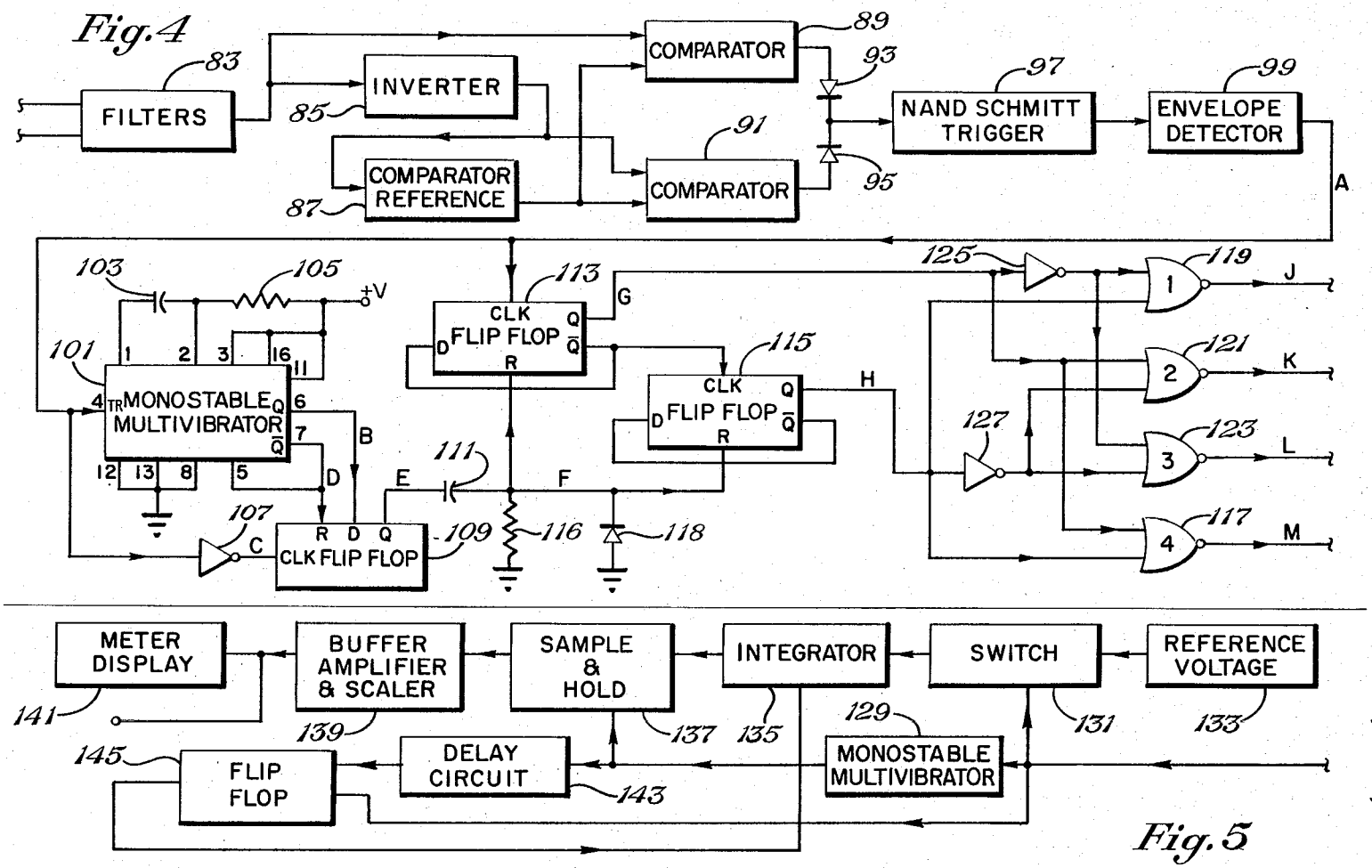
FIG. 4 is a block diagram of part of the uphole components of a telemetry system constructed in accordance with this invention.
FIG. 5 is a block diagram of another part of the uphole portion of the telemetry system of FIG. 4.

FIG. 4 represents the surface equipment, which demodulates the carrier signal and ultimately applies it to a meter display. In the surface unit, filters 83 are tapped onto the power cables 18 (FIG. 1), for receiving the modulated carrier signal. Filters 83 pass the carrier frequency and block other frequencies. The output from filters 83 is applied to a comparator 89 and also to an inverter 85. Inverter 85 is connected to a comparator reference 87, which is connected to a second comparator 91, identical to comparator 89. The outputs of the comparators 89 and 91 are applied through diodes 93 and 95 to a NAND Schmitt trigger 97.

Figure 6:
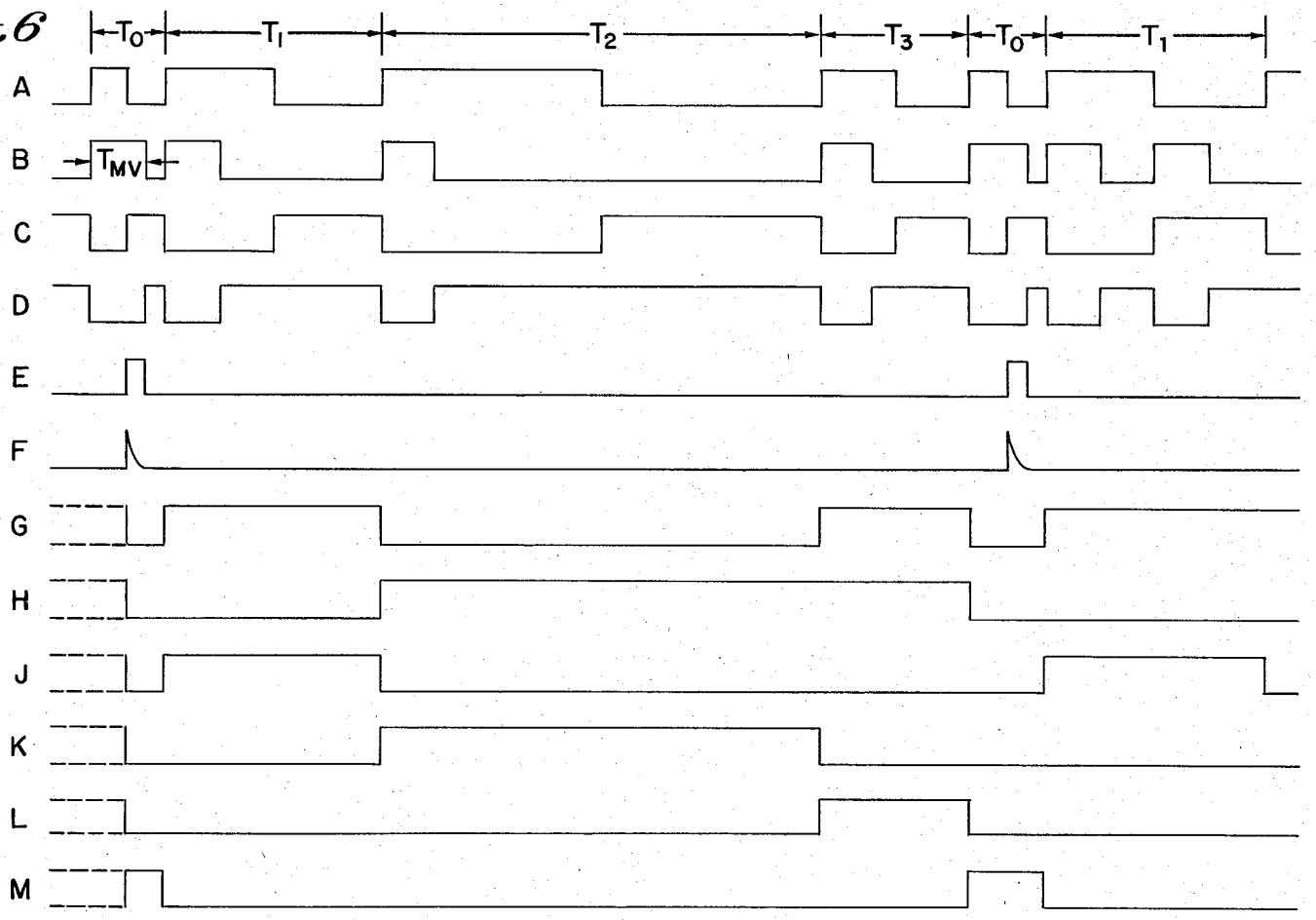
FIG. 6 is a series of waveforms at various points in the block diagram of FIG. 4.

The comparator reference circuit 87 functions to set the switching level of the comparators 89 and 91 approximately at the midpoint amplitude of each signal of the carrier frequency. This minimizes timing errors associated with the buildup and decay time of the signal. The NAND Schmitt trigger 97 provides pulses to a retriggerable monostable multivibrator, which functions as an envelope detector 99. The waveform at point A is shown on FIG. 6, and is identical to the waveform at point A in FIG. 2. Filters 83, inverter 85, comparators 89 and 91, comparator reference 87, NAND Schmitt trigger 97 and envelope detector 99 are conventional circuits, and are shown in more detail in the parent application.

The output of the envelope detector 99 is applied to a synchronizing means which is part of a decoding means and determines when the carrier signal is in the $T_0$ mode. This synchronizing means includes a conventional monostable multivibrator 101, preferably a CD4098B component. The monostable multivibrator has a time constant that is adjusted so that its time interval is slightly less than $T_0$ but greater than 0.5 $T_0$. Monostable multivibrator 101 is connected as a positive edge triggered device as shown in the drawing, including a capacitor 103 connected between pins 1 and 2 and a resistor 105 connected between pin 2 and a power source. The output from the envelope detector 99 is also applied to an inverter 107, which is applied to a flip-flop 109. As shown in the timing diagram of FIG. 6, flip-flop 109 will provide a high output only when the Q output of the monostable multivibrator 101 is high and the output of the inverter 107 goes high. This will occur only during the $T_0$ time interval because the time constant of the multivibrator is adjusted so that in the other time intervals, its Q output will go low before the time interval $T_1$, $T_2$, or $T_3$ goes low. As a result, a reset signal E will occur only during each $T_0$ interval.

The Q output of flip-flop 109 resets a surface sequencing means for directing data envelopes, $T_1$, $T_2$ and $T_3$ to respective read out means. The output E (FIG. 6) is applied through a capacitor 111 to the reset terminal of two D flip-flops 113 and 115. The reset terminal of the flip-flops 113 and 115 are connected conventionally through a resistor 116 to ground and have a protective diode 118 connected to ground. The reset pulse from the flip-flop 109 resets each flip-flop 113 and 115 so that each Q output will be zero. Flip-flops 113 and 115 correspond to the downhole flip-flops 65 and 67 of FIG. 1, with flip-flop 113 being connected to the envelope detector 99 output and triggering on each rising signal. Flip-flop 115 has its clock input connected to flip-flop 113 and will trigger on each positive going signal received from the $\overline{Q}$ output of flip-flop 113.

Flip-flops 113 and 115 are connected to a series of inverters and NOR gates that are identical to the inverters and NOR gates of FIG. 1. The two low outputs of flip-flops 113 and 115 when reset provide low outputs to a NOR gate 117, which provdes a high output. The output of NOR gate 117 can be used for calibration since the resistance of the resistor 43 of FIG. 1 and other components in the system may change with temperature.

The other NOR gates and inverters in the surface receiver include a NOR gate 119 which has one input connected to the output of flip-flop 115. A NOR gate 121 is connected to the output of flip-flop 113. A NOR gate 123 is connected to one input of NOR gate 119. An inverter 125 is connected between the Q output of flip-flop 113 and NOR gate 119. Inverter 127 is connected between the Q output of flip-flop 115 and NOR gate 123.

Once the reset signal has occured, the monostable multivibrator 101 and flip-flop 109 will have no effect on the flip-flops 113 and 115 until the next $T_0$ signal. With the beginning of the $T_1$ signal from the envelope detector 99, as shown in the timing diagram of FIG. 6, the Q output of flip-flop 113 will go high and the Q output of flip-flop 115 remains low. This results in a high output of NOR gate 119. At the conclusion of the $T_1$ time interval, the arrival of the $T_2$ signal causes the flip-flop 113 Q output to go low. The positive going signal at $\overline{Q}$ causes the flip-flop 115 output to go high. These outputs combine to cause a high output at NOR gate 121. The $T_3$ time interval will similarly cause a high output at the NOR gate 123. The high outputs of each NOR gate remain for the duration of each time interval. Each time interval is proportional to the output of the corresponding downhole transducer.

FIG. 5 shows one readout means by which to display a value corresponding to each data envelope $T_1$ through $T_3$. In this embodiment, each NOR gate 119, 121 and 123 would be connected to a separate and identical circuit as shown in FIG. 5. The circuit shown in FIG. 5 contains conventional components, shown in block diagram. Details of the circuitry are shown in the parent application to this application. The circuitry includes a monostable multivibrator 129 that has its input connected to one of the NOR gates 119, 121 or 123. A rising input signal does not trigger monostable multivibrator 129 since it is connected as a negative edge triggered device. A high input signal turns on switch 131. Switch 131 has its input connected to a reference voltage source 133, and begins passing this reference voltage to an integrator circuit 135. The rising signal of $T_1$ sets a flip flop 145 to enable integrator 135. The integrator 135 begins ramping up the reference voltage from voltage source 133.

The falling edge signal from one of the NOR gates 119, 121 or 123 indicates the conclusion of $T_1$, $T_2$ or $T_3$, and triggers the monostable multivibrator 129 to actuate the sample and hold circuit 137. The sample and hold circuit 137 then passes an instantaneous value from the integrator 135 to a buffer amplifier and scaler circuit 129 and to a meter display 141. The sample and hold circuit 137 holds this instantaneous value. The high output from the monostable multivibrator 129 goes through a delay circuit 143 to reset flip-flop 145. Flip-flop 145 in turn resets the integrator 135 to zero. The switch 131 is turned off when the input signal from the NOR gate goes low. The beginning of the next time interval will cause this cycle to be repeated for the next data channel.

The invention has significant advantages. Three or more parameters can be sensed and monitored at the surface, along with a reference signal for calibration and for temperature compensation. The system does not require DC to be superimposed onto the power cables as in the prior art. The insulation of the power cables will not affect the accuracy of the readings. The insulation of the power cables can be tested under high voltage conditions without being influenced by the downhole transducers. All of the components of the system are conventional.

While the invention has been shown in only one of its forms, it should be apparent to those skilled in the art that it is not so limited but is susceptible to various changes and modifications without departing from the scope of the invention.

I claim:

1. In a pump installation having a power cable for delivering AC power from a power source at the surface to an AC motor located in a well, measuring means for monitoring at the surface physical parameters in the environment of the motor, comprising in combination:

a downhole assembly located in the well in the vicinity of the motor and having a transmitter means for generating a carrier signal and for superimposing the carrier signal onto the power cable;

switching means for switching the carrier signal on and off the power cable;

a plurality of transducer means in the downhole assembly, each for providing a variable electrical response corresponding to a physical parameter of the motor environment;

modulating means in the downhole assembly for providing controlling signals to the switching means to switch the carrier signal on for a duration corresponding to an electrical response of the transducer means;

sequencing means in the downhole assembly for sequentially switching each of the transducer means separately into the modulating means to provide a carrier signal with envelopes of on duration corresponding to the electrical response of each of the transducer means; and conversion means at the surface for detecting the length of each envelope and for converting the length into readout signals proportional to the physical parameter.

2. In a pump installation having a power cable for delivering AC power from a power source at the surface to an AC motor located in a well, measuring means for monitoring at the surface physical parameters in the environment of the motor, comprising in combination:

a downhole assembly located in the well in the vicinity of the motor and having a transmitter means for generating a carrier signal and for superimposing the carrier signal onto the power cable;

switching means for switching the carrier signal on and off the power cable;

a plurality of transducer means in the downhole assembly, each for providing a variable resistance corresponding to a physical parameter of the motor environment;

modulating means in the downhole assembly for providing controlling signals to the switching means to switch the carrier signal on and off;

sequencing means in the downhole assembly for sequentially switching each of the transducer means separately to the modulating means to provide the carrier signal with a pulse train of data envelopes, each data envelope being of duration corresponding to the resistance of each of the transducer means;

synchronizing means in the downhole assembly for providing a synchronizing signal to the switching means to provide the carrier signal with a synchronizing envelope prior to each data envelope in the pulse train; and decoding means at the surface for detecting the synchronizing envelope and directing the data envelopes to respective readout means for converting the data envelopes into readout signals proportional to the parameter sensed.

3. In a pump installation having a power cable for delivering AC power from a power source at the surface to an AC motor located in a well, measuring means for monitoring at the surface physical parameters in the environment of the motor, comprising in combination:

a downhole assembly located in the well in the vicinity of the motor and having a transmitter means for generating a carrier signal and for superimposing the carrier signal onto the power cable;

switching means for switching the carrier signal on and off the power cable;

a plurality of transducer means in the downhole assembly, each for providing a variable resistance corresponding to a physical parameter of the motor environment;

a synchronizing resistor in the downhole assembly;

modulating means in the downhole assembly for turning the switching mean on then off for a combined duration which corresponds to a resistance of each of the transducer means and also to the resistance of the synchronizing resistor;

sequencing means in the downhole assembly for sequentially switching each of the transducer means and the synchronizing resistor separately to the modulating means to provide the carrier signal with data envelopes with on and off duration corresponding to the resistance of each of the transducer means and with a synchronizing envelope of on and off duration corresponding to the synchronizing resistor; and decoding means at the surface for detecting the synchronizing envelope and directing the data envelopes to respective readout means for converting the data envelopes into readout signals proportional to the parameter sensed.

4. In a pump installation having a power cable for delivering AC power from a power source at the surface to an AC motor located in a well, measuring means for monitoring at the surface physical parameters in the environment of the motor, comprising in combination:

a downhole assembly located in the well in the vicinity of the motor and having a transmitter means for generating a carrier signal and for superimposing the carrier signal onto the power cable;

switching means for switching the carrier signal on and off the power cable;

a plurality of transducer means in the downhole assembly, each for providing a variable resistance corresponding to a physical parameter of the motor environment;

modulating means in the downhole assembly for charging a capacitor, then discharging the capacitor through a synchronizing resistance to turn on and off the switching means for equal duration corresponding to the synchronizing resistance, to provide the carrier signal with a synchronizing envelope that has an on and off duration corresponding to the synchronizing resistance;

downhole sequencing means in the downhole assembly for swithing each of the transducer means separately to the modulating means in place of the synchronizing resistance to provide the carrier signal with data envelopes with on and off duration corresponding to the resistance of the transducer means, the downhole sequencing means being triggered by the switching of the switching means;

the synchronizing resistance being selected to provide a synchronizing envelope of duration less than the duration of any of the data envelopes;

a plurality of readout means at the surface, each corresponding to one of the transducer means, for converting each of the data envelopes to a readout signal proportional to the parameter sensed;

surface sequencing means at the surface for sequentially turning on each of the readout means for the duration of each of the data envelopes, the surface sequencing means being triggered by the receipt of one of the data envelopes; and synchronizing means at the surface for detecting the synchronizing envelope and for resetting the sequencing means upon receipt of the synchronizing envelope, to assure that each of the readout means is turned on by its respective data envelope.

* * * * *